US009513080B1

(12) United States Patent
Kempf et al.

(10) Patent No.: US 9,513,080 B1
(45) Date of Patent: Dec. 6, 2016

(54) REVERSE STYLE CROSSBOW

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

( * ) Notice: Subject to any disclaimer, the term of this patent is extended or adjusted under 35 U.S.C. 154(b) by 0 days.

(21) Appl. No.: 15/046,472

(22) Filed: Feb. 18, 2016

Related U.S. Application Data

(60) Provisional application No. 62/132,859, filed on Mar. 13, 2015.

(51) Int. Cl.
*F41B 5/12* (2006.01)
*F41B 5/10* (2006.01)
*F41B 5/14* (2006.01)

(52) U.S. Cl.
CPC ..... *F41B 5/123* (2013.01); *F41B 5/105* (2013.01); *F41B 5/1411* (2013.01)

(58) Field of Classification Search
CPC ..... F41B 5/123; F41B 5/105; F41B 5/1411; F41B 5/12; F41B 5/0094
See application file for complete search history.

(56) References Cited

U.S. PATENT DOCUMENTS 5,054,463 A * 10/1991 Colley ..... F41B 5/10 124/25.6
5,673,677 A * 10/1997 Wing ..... F41B 5/0094 124/17
5,678,528 A * 10/1997 Hadley ..... F41B 5/12 124/24.1
7,578,289 B2 * 8/2009 Norkus ..... F41B 5/0094 124/25
8,578,918 B1 * 11/2013 Islas ..... F41B 5/123 124/25
8,651,095 B2 * 2/2014 Islas ..... F41B 5/105 124/25
9,243,861 B1 * 1/2016 Kempf ..... F41B 5/12
9,297,604 B1 * 3/2016 Sidebottom ..... F41B 5/123
2008/0251058 A1 * 10/2008 Colley ..... F41B 5/105 124/25
2011/0056467 A1 * 3/2011 Popov ..... F41B 5/0094 124/25.6
2013/0312724 A1 * 11/2013 Hudkins ..... F41B 5/123 124/25
2014/0261360 A1 * 9/2014 Pulkrabek ..... F41B 5/1469 124/35.2

* cited by examiner

*Primary Examiner* — Melba Bumgarner
*Assistant Examiner* — Amir Klayman
(74) *Attorney, Agent, or Firm* — Donald J. Ersler

(57) ABSTRACT

A reverse style crossbow preferably includes a bow riser, a barrel, a latch, a first limb, a second limb, a first cam, a second cam, a first string pulley, a second string pulley and a bowstring. The riser is attached to the barrel at substantially a middle thereof. The first limb extends from a first end of the riser and the second limb extends from a second end of the riser. The first cam is pivotally retained on a distal end of the first limb and the second cam is pivotally retained on a distal end of the second limb. The latch is attached to a top of the barrel. The riser may be located in front of the latch, behind the latch or under the latch. The first string pulley extends from one side of the barrel and the second string pulley extends from an opposing side thereof.

16 Claims, 10 Drawing Sheets

REVERSE STYLE CROSSBOW

CROSS-REFERENCES TO RELATED APPLICATIONS

This is a utility patent application taking priority from provisional application No. 62/132,859 filed on Mar. 13, 2015.

BACKGROUND OF THE INVENTION

1. Field of the Invention

The present invention relates generally to archery and more specifically to a reverse style crossbow, which extends the power stoke out in front of the cams.

2. Discussion of the Prior Art

Historically, archery bows and crossbows have been used for war, survival, sport, and recreation.

Accordingly, there is a clearly felt need in the art to provide a reverse style crossbow, which has more accuracy and consistency than that of the prior art by retaining the string guide pulleys in a static location at the front of the crossbow and by extending a power stroke in front of the cams.

SUMMARY OF THE INVENTION

The present invention provides a reverse style crossbow, which has more accuracy and consistency than that of the prior art by retaining the string guide pulleys in a static location at the front of the crossbow. The reverse style crossbow preferably includes a bow riser, a barrel, a latch, a first limb, a second limb, a first cam, a second cam, a string guide pulley assembly and a bowstring. The riser is attached to the barrel at substantially a middle thereof. The first limb extends from a first end of the riser and the second limb extends from a second end of the riser. The first cam is pivotally retained on a distal end of the first limb with a first axle and the second cam is pivotally retained on a distal end of the second limb with a second axle. The latch is retained within a latch housing and the latch housing is retained within the barrel. The riser may be located in front of the latch, behind the latch or under the latch.

The string guide pulley assembly includes a pulley support frame, a first string pulley and a second string pulley. The first string pulley is pivotally retained on a first end of the pulley support frame and the second string pulley is pivotally retained a second end of the pulley support frame. A middle of the pulley support frame is attached to the barrel. A first end loop of the bowstring is attached to the first cam and a first end portion of the bowstring is wrapped on an outer perimeter of the first cam. A second end loop of the bowstring is attached to the second cam and a second end portion of the bowstring is wrapped on an outer perimeter of the second cam. As the bowstring is drawn, the first and second end portions of the bowstring unwrap from an inner or outer portion of the outer perimeter of the first and second cams.

A first cable pulley is located behind the first string guide pulley and a second cable pulley is located behind the second string guide pulley. Each end of a first cable is attached to the first cam and retained by the first cable pulley. Each end of a second cable is attached to the second cam and retained by the second cam pulley. The first and second cable pulleys may be replaced with first and second semi-circular cable tracks. Alternatively, the first and second cable pulleys may be eliminated. One end of the first cable is attached to the first cam and an opposing end of the first cable is attached to the second cam, the second limb or the second axle of the second cam. One end of the second cable is attached to the second cam and an opposing of the second cable is attached to the first cam, the first limb or the first axle of the first cam.

Accordingly, there is a clearly felt need in the art for a reverse style crossbow, which has more accuracy and consistency than that of the prior art by retaining the pulleys in a static location at the front of the crossbow and by extending a power stroke in front of the cams.

These and additional objects, advantages, features and benefits of the present invention will become apparent from the following specification.

DETAILED DESCRIPTION OF THE PREFERRED EMBODIMENTS

Figure 1:
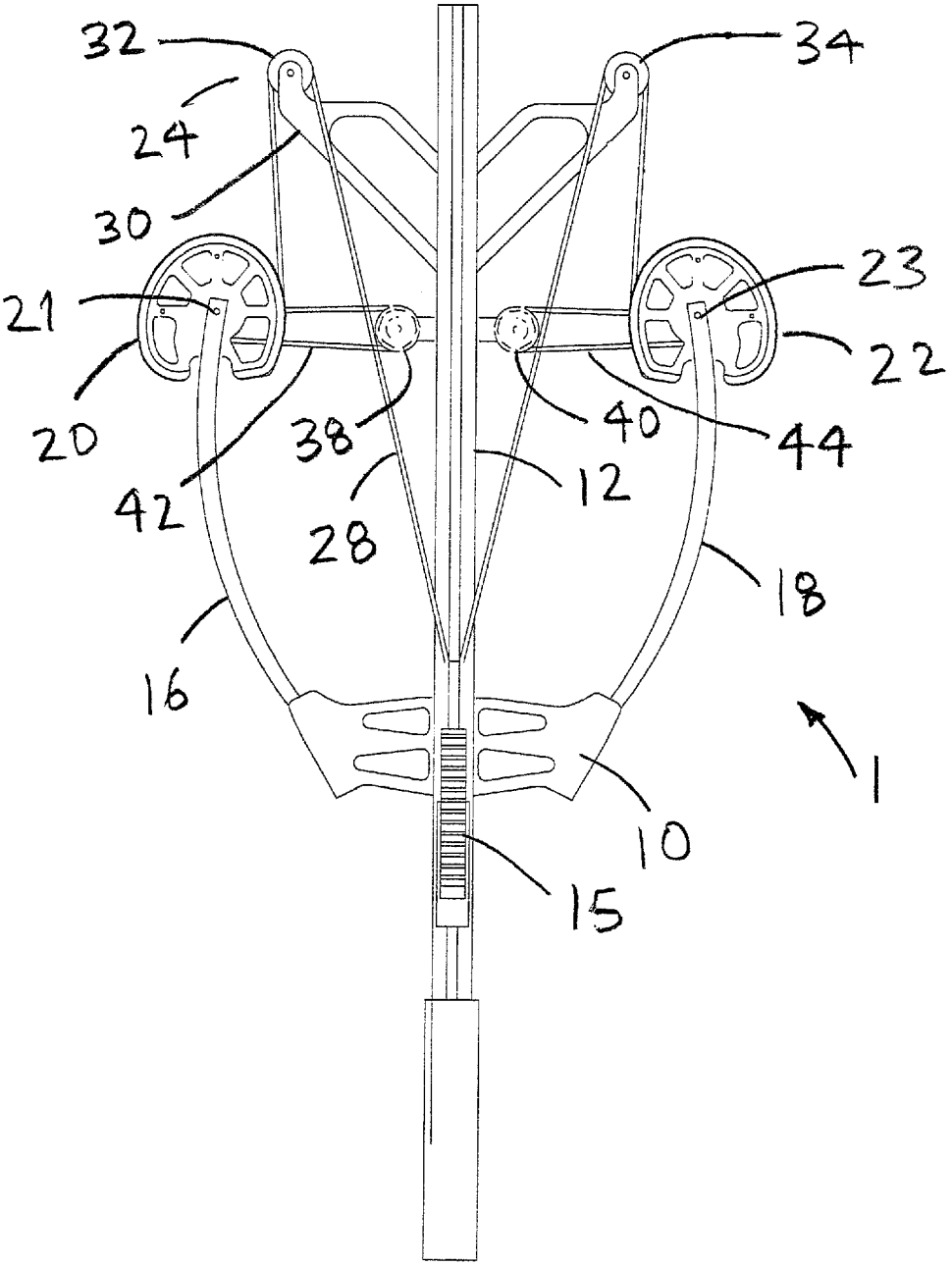
FIG. 1 is a top view of a reverse style crossbow with a riser in front of a latch; a bowstring coming off an inside portion of an outer perimeter of first and second cams; a bow string partially cocked; and first and second cables retained on first and second pulleys in accordance with the present invention.
Figure 2:
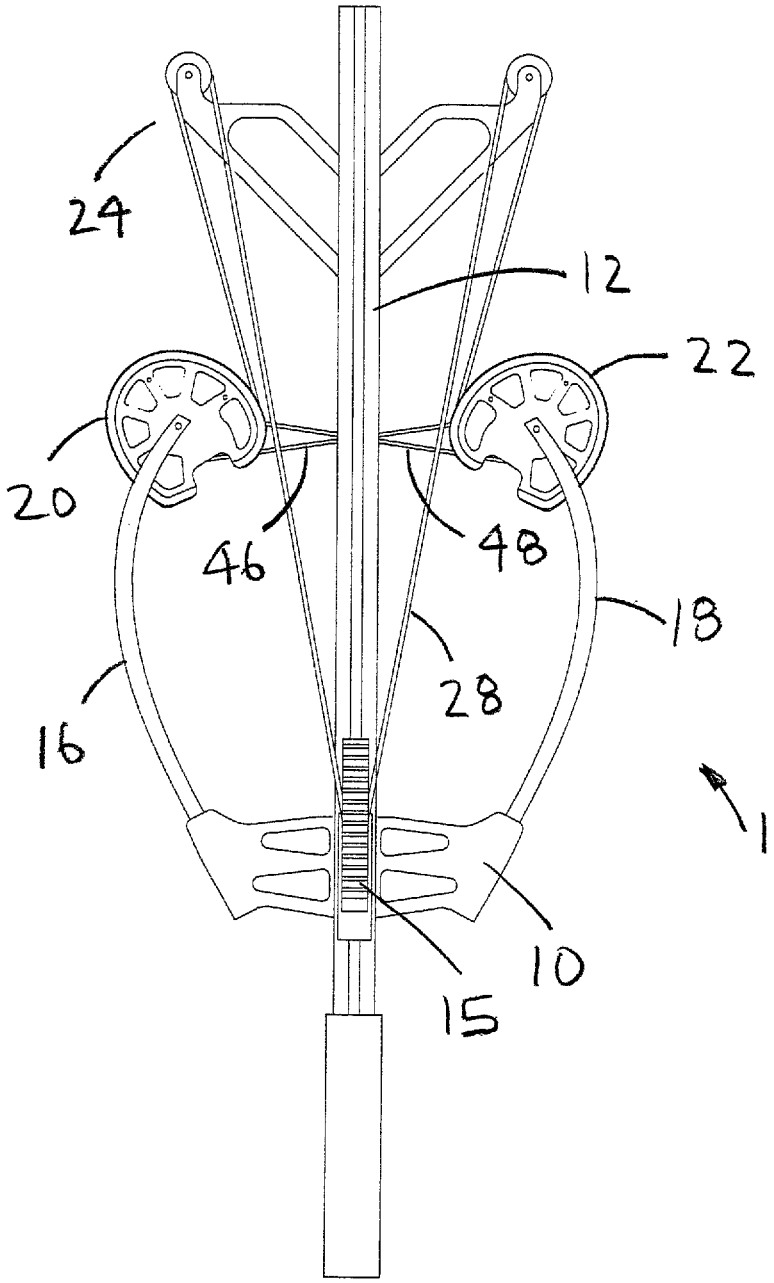
FIG. 2 is a top view of a reverse style crossbow with a riser under a latch; a bowstring coming off an inside portion of an outer perimeter of first and second cams; a bow string cocked; and first and second cables attached to first and second cams in accordance with the present invention.
Figure 2A:
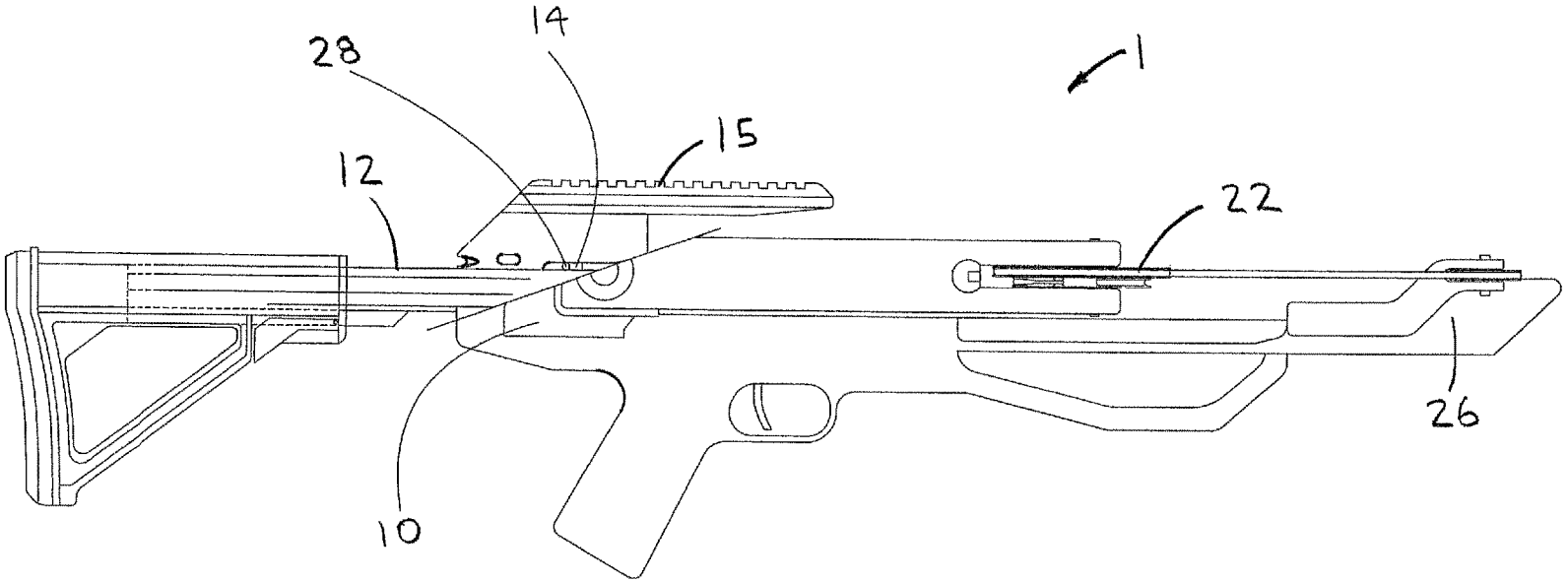
FIG. 2A is a side view of a reverse style crossbow with a riser under a latch; a bowstring coming off an inside portion of an outer perimeter of first and second cams; a bow string cocked; and first and second cables attached to first and second cams in accordance with the present invention.
Figure 3:
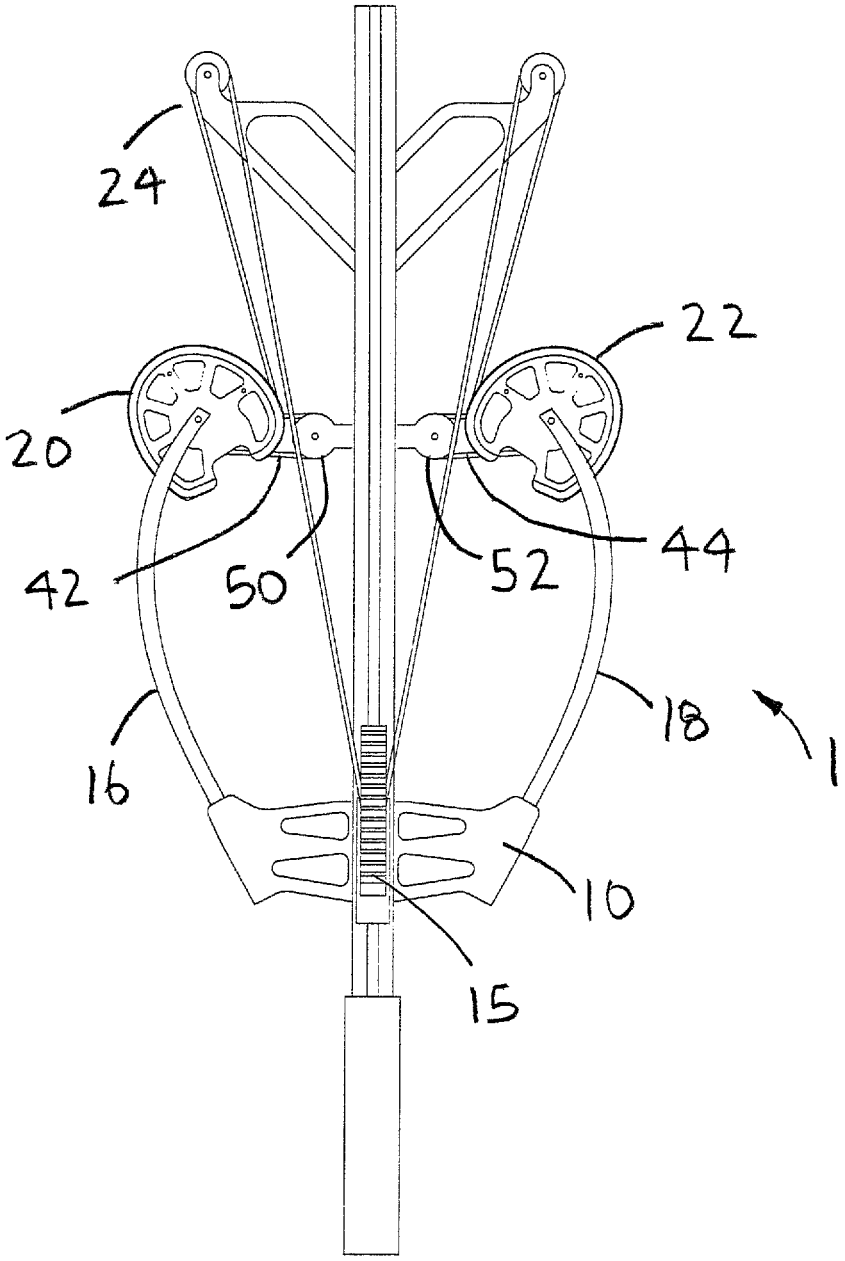
FIG. 3 is a top view of a reverse style crossbow with a riser under a latch; a bowstring coming off an inside portion of an outer perimeter of first and second cams; a bowstring cocked; and first and second cables retained in first and second semi-circular tracks in accordance with the present invention.
Figure 4:
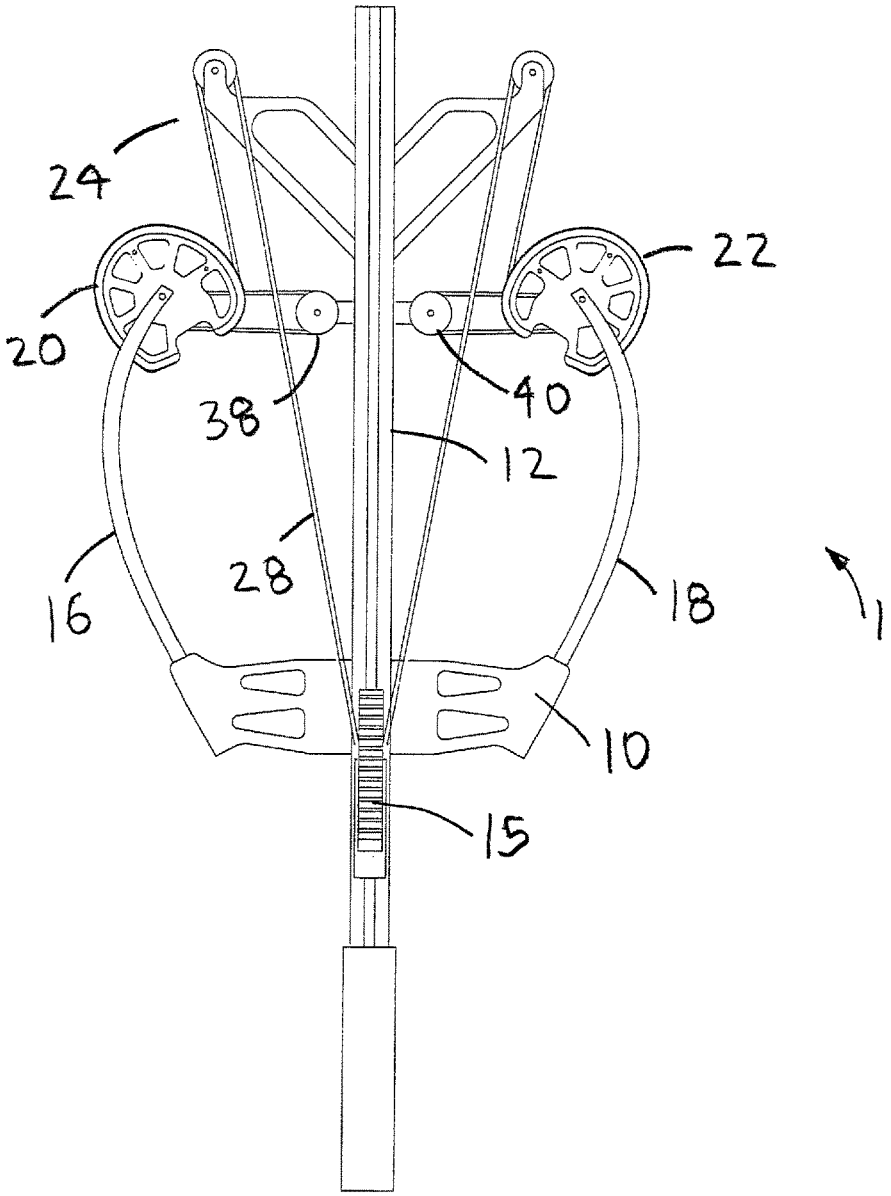
FIG. 4 is a top view of a reverse style crossbow with a riser in front of a latch; a bowstring coming off an inside portion of an outer perimeter of first and second cams; a bow string cocked; and first and second cables retained on first and second pulleys in accordance with the present invention.
Figure 4A:
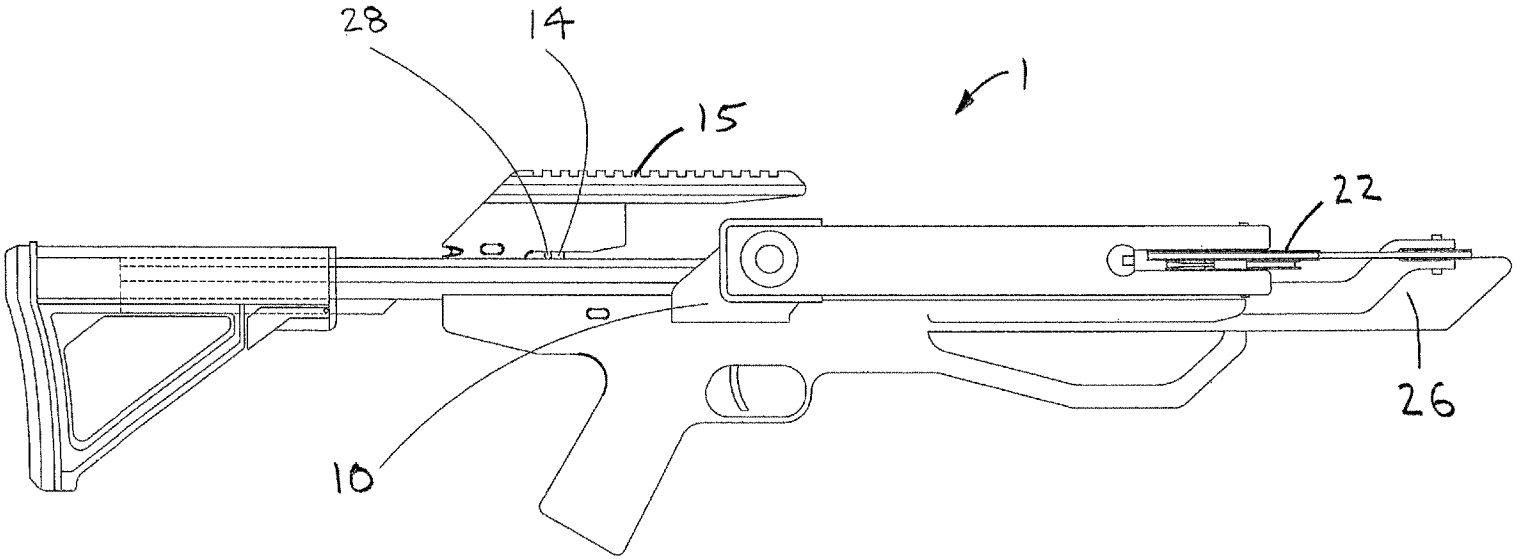
FIG. 4A is a side view of a reverse style crossbow with a riser in front of a latch; a bowstring coming off an inside portion of an outer perimeter of first and second cams; a bow string cocked; and first and second cables retained on first and second pulleys in accordance with the present invention.
Figure 5:
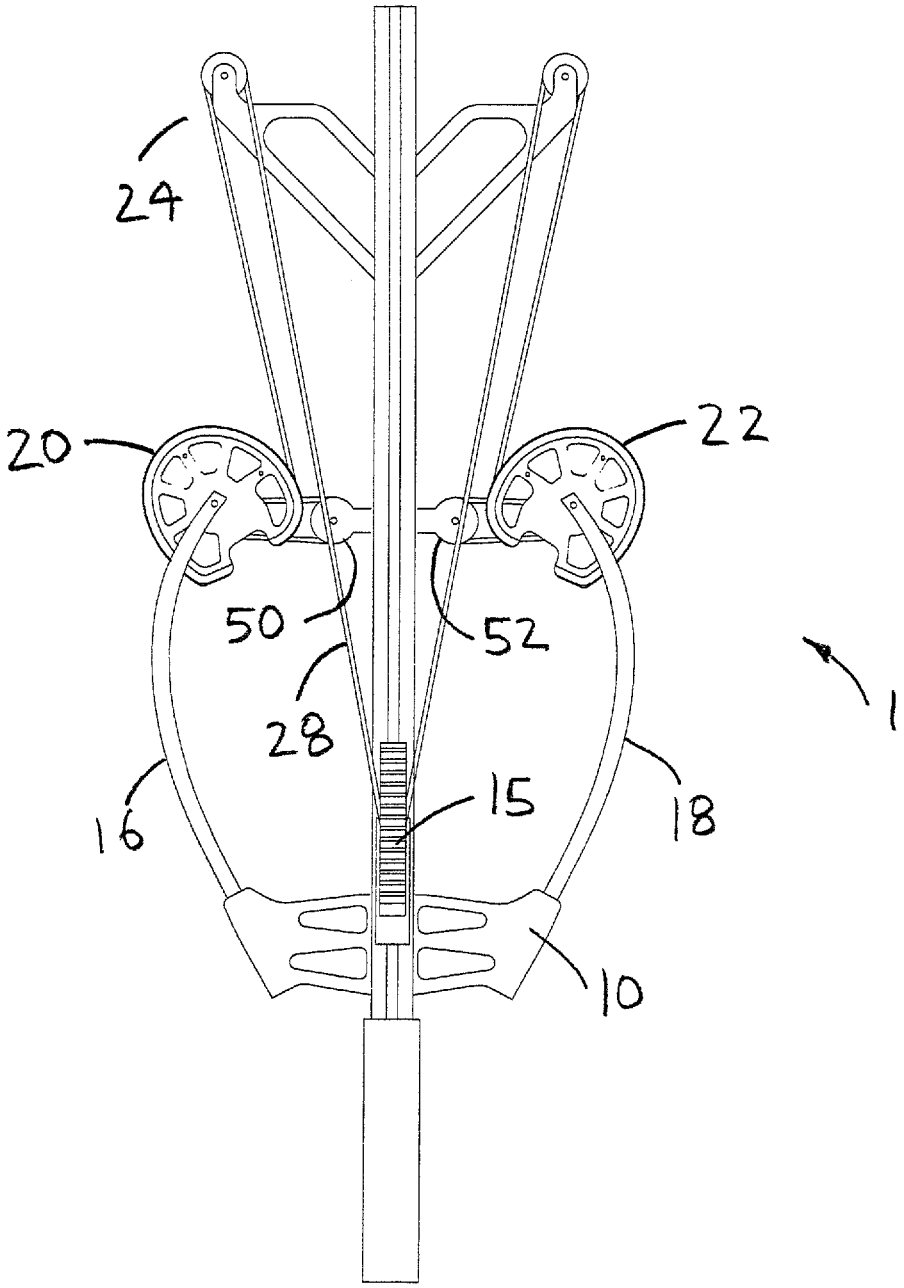
FIG. 5 is a top view of a reverse style crossbow with a riser behind a latch; a bowstring coming off an inside portion of an outer perimeter of first and second cams; a bowstring cocked; and first and second cables retained in first and second semi-circular tracks in accordance with the present invention.
Figure 5A:
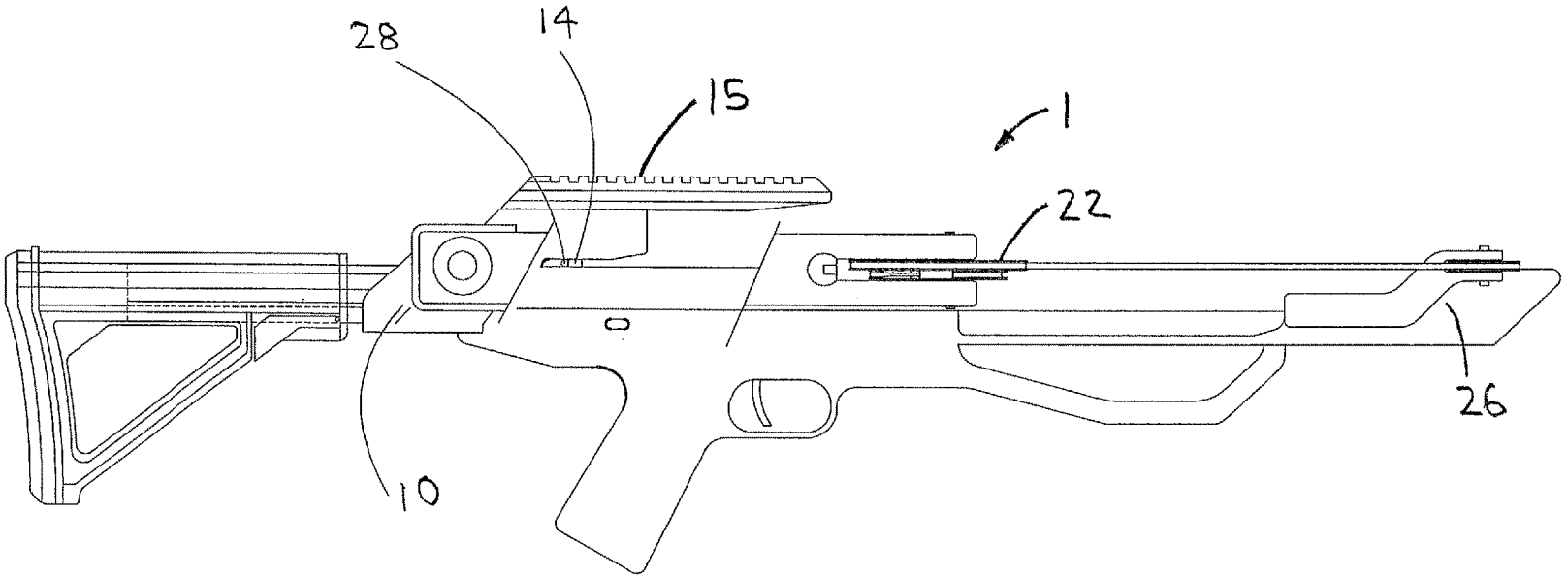
FIG. 5A is a side view of a reverse style crossbow with a riser behind a latch; a bowstring coming off an inside portion of an outer perimeter of first and second cams; a bowstring cocked; and first and second cables retained in first and second semi-circular tracks in accordance with the present invention.
Figure 6:
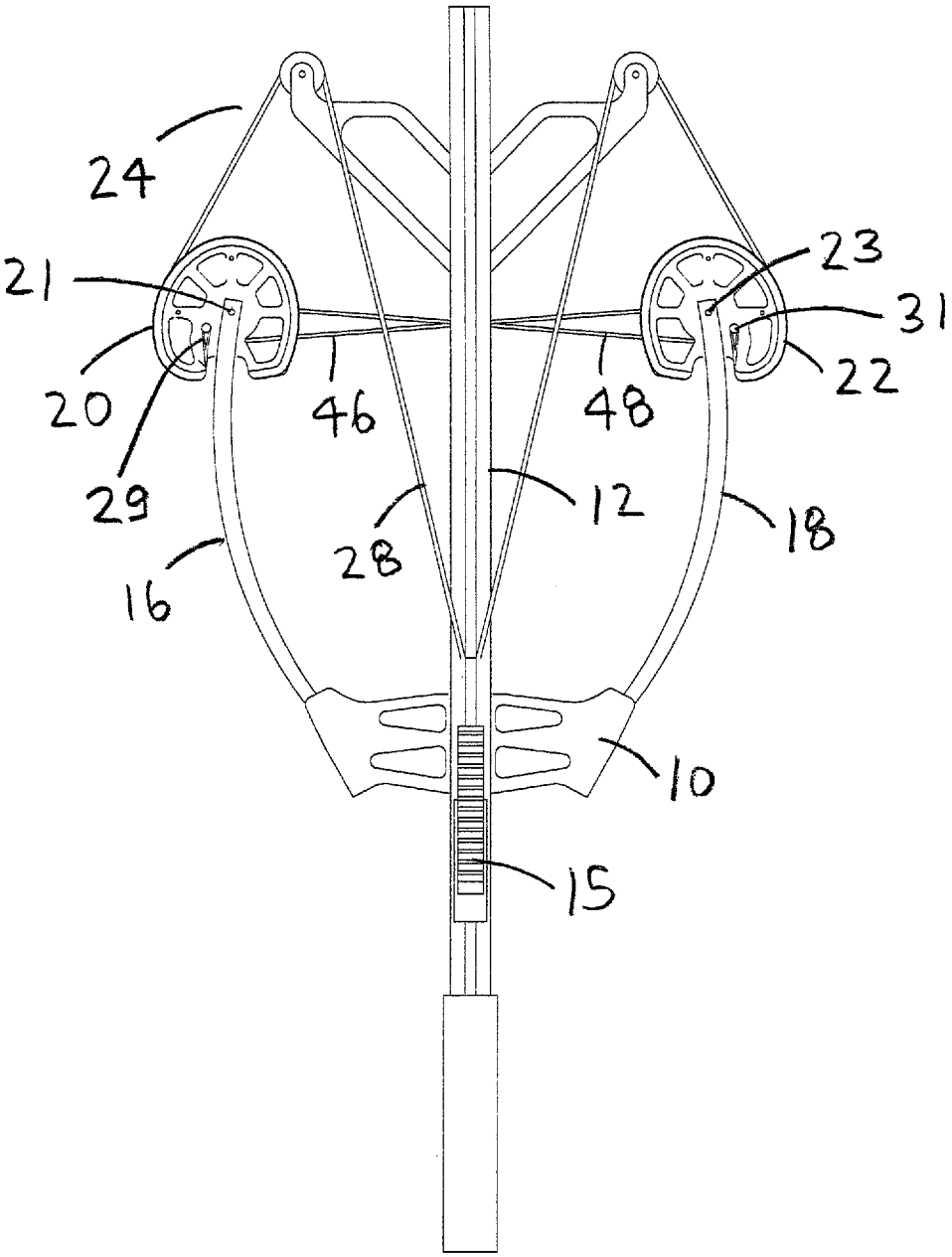
FIG. 6 is a top view of a reverse style crossbow with a riser in front of a latch; a bowstring coming off an outside portion of an outer perimeter of first and second cams; a bowstring partially cocked; and first and second cables attached to first and second cams in accordance with the present invention.
Figure 7:
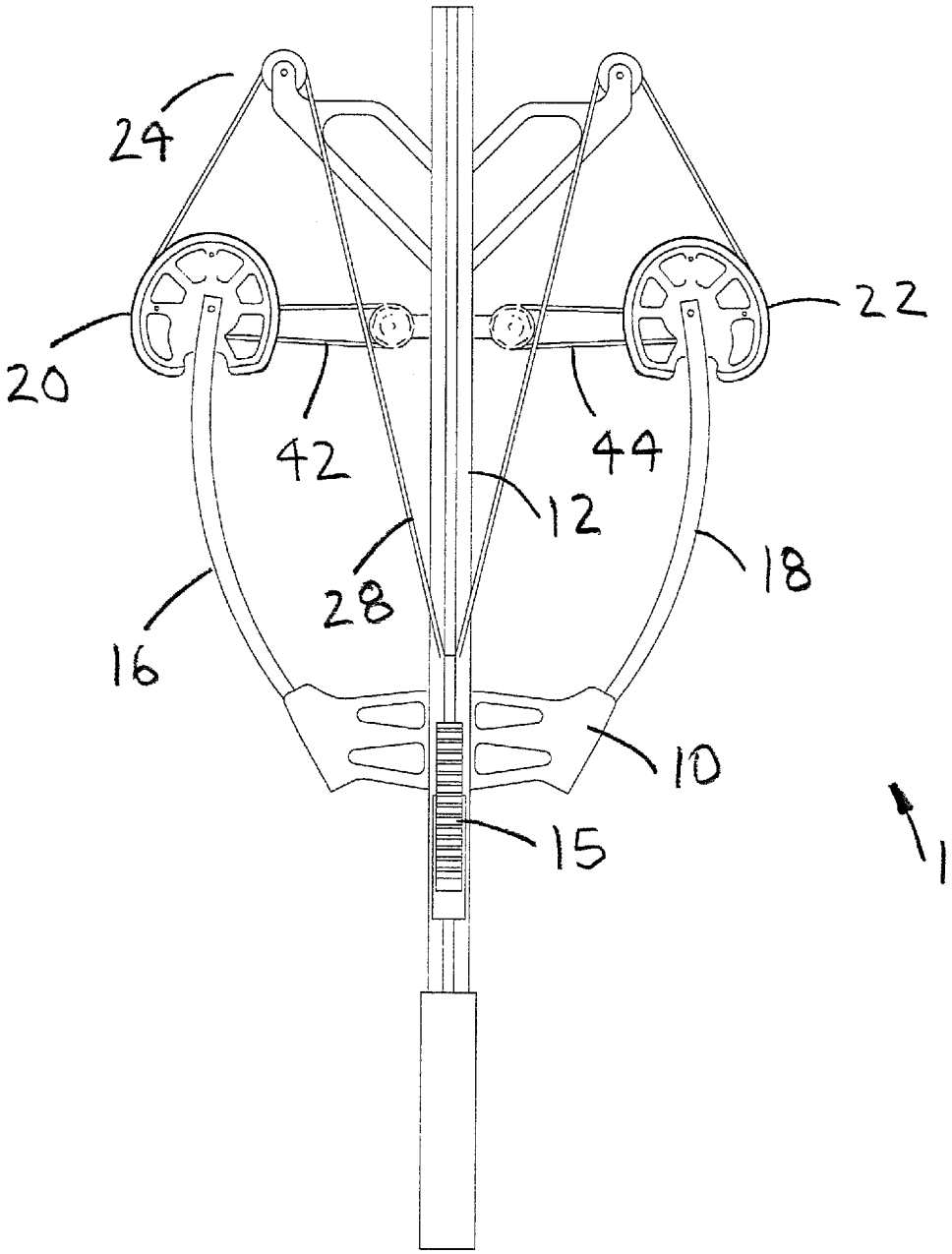
FIG. 7 is a top view of a reverse style crossbow with a riser in front of a latch; a bowstring coming off an outside portion of an outer perimeter of first and second cams; a bow string partially cocked; and first and second cables retained on first and second pulleys in accordance with the present invention.

With reference now to the drawings, and particularly to FIG. 1, there is shown a top view of a reverse style cross bow 1. The reverse style crossbow 1 preferably includes a bow riser 10, a barrel 12, a latch 14, a first limb 16, a second limb 18, a first cam 20, a second cam 22, a string guide pulley assembly 24 and a bowstring 28. The riser 10 is attached to the barrel 12 at substantially a middle thereof. The first limb 16 extends from a first end of the riser 10 and the second limb 18 extends from a second end of the riser 10. The first cam 20 is pivotally retained on a distal end of the first limb 16 with a first axle 21 and the second cam 22 is pivotally retained on a distal end of the second limb 18 with a second axle 23. With reference to FIGS. 2A, 4A and 5A, the latch 14 is retained in a latch housing 15. The latch housing 15 is retained within the barrel 12. With reference to FIGS. 2-7, the riser 10 may be located in front of the latch 14, behind the latch 14 or under the latch 14.

The string guide pulley assembly 24 includes a pulley support frame 30, a first string pulley 32 and a second string pulley 34. The first string pulley 32 is pivotally retained on a first end of the pulley support frame 30 and the second string pulley 34 is pivotally retained a second end of the pulley support frame 30. A middle of the pulley support frame 30 is attached to the barrel 12. A first end loop 29 of the bowstring 28 is attached to the first cam 20 and a first end portion of the bowstring 28 is wrapped on outer perimeter of the first cam 20. A second end loop 31 of the bowstring 28 is attached to the second cam 22 and a second end portion of the bowstring is wrapped on outer perimeter of the second cam 22. As the bowstring 28 is drawn, the first and second end portions of the bowstring 28 unwrap from an inside portion of an outer perimeter of the first and second cams 20, 22 in FIGS. 1-5, or an outside portion of the outer perimeter of the first and second cams 20, 22 in FIGS. 6-7.

A first cable pulley 38 and a second cable pulley 40 are located behind the string guide pulley assembly 24. Each end of a first cable 42 is attached to the first cam 20 and retained by the first cable pulley 38. Each end of a second cable 44 is attached to the second cam 22 and retained by the second cam pulley 40. With reference to FIGS. 3 and 5, the first and second cable pulleys 38, 40 may be replaced with first and second semi-circular cable tracks 50, 52. One end of the first cable 42 is attached to the first cam 20 and an opposing end of the first cable 42 is attached to the second cam 22, the second limb 18 or the second axle 23 of the second cam 22. One end of the second cable 44 is attached to the second cam 22 and an opposing of the second cable 44 is attached to the first cam 20, the first limb 16 or the first axle 21 of the first cam 20.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A reverse style crossbow comprising:

a barrel having an elongated length and a distal end;

a bow riser having a first end and a second end, said bow riser is attached to said barrel;

a first limb extending from said first end of said bow riser;

a second limb extending from said second end of said bow riser;

a first cam includes a first cam track, said first cam is pivotally retained on a distal end of said first limb;

a second cam includes a second cam track, said second cam is pivotally retained on a distal end of said second limb;

a first string guide pulley is pivotally retained on one side of said barrel and adjacent said distal end of said barrel;

a second string guide pulley is pivotally retained on an opposing side of said barrel and adjacent said distal end of said barrel;

a bow string having a first end attached to said first cam, a second end attached to said second cam and supported by said first and second string guide pulleys, said first and second cams being located between said first and second string guide pulleys and said riser along an axis of said barrel, wherein a first end of said bow string unwinds from said first cam, a second end of said bow string unwinds from said second cam; and a latch for retaining said bow string in a cocked postion, said latch is retained adjacent said barrel, said bow riser is located adjacent said latch.

2. The reverse style crossbow of claim 1 wherein:

said riser is located in one of in front of said latch, behind said latch and below said latch.

3. The reverse style crossbow of claim 1 wherein:

said bowstring is unwrapped from an inside portion of an outer perimeter of said first and second cams.

4. The reverse style crossbow of claim 1 wherein:

said bowstring is unwrapped from an outside portion of an outer perimeter of said first and second cams.

5. The reverse style crossbow of claim 1 wherein:

a pulley support frame is attached to said one end of said barrel, said first string guide pulley is pivotally retained on one end of said pulley support frame, said second string guide pulley is pivotally retained on an opposing end of said pulley support frame.

6. A reverse style crossbow comprising:

a barrel having an elongated length and a distal end;

a bow riser having a first end and a second end, said bow riser is attached to said barrel;

a first limb extending from said first end of said bow riser;

a second limb extending from said second end of said bow riser;

a first cam includes a first cam track, said first cam is pivotally retained on a distal end of said first limb;

a second cam includes a second cam track, said second cam is pivotally retained on a distal end of said second limb;

a first string guide pulley is pivotally retained on one side of said barrel and adjacent said distal end of said barrel;

a second string guide pulley is pivotally retained on an opposing side of said barrel and adjacent said distal end of said barrel;

a bow string having a first end attached to said first cam, a second end attached to said second cam and supported by said first and second string guide pulleys, said first and second cams being located between said first and second string guide pulleys and said riser, along an axis of said barrel wherein a first end of said bow string unwinds from said first cam, a second end of said bow string unwinds from said second cam;

one of a first cable pulley and a first cable track;

one of a second cable pulley and a second cable track;

a first cable having one end retained by said first cam, a portion of said first cable is retained by one of said first cable pulley and said first cable track, the other end of said first cable is coupled to said first cam;

a second cable having one end retained by said second cam, a portion of said second cable is retained by one of said second cable pulley and said second cable track, the other end of said second cable is coupled to said second cam; and a latch for retaining said bow string in a cocked portion, said latch is retained adjacent said barrel, said bow riser is located adjacent said latch.

7. The reverse style crossbow of claim 6 wherein:

said riser is located in one of in front of said latch, behind said latch and below said latch.

8. The reverse style crossbow of claim 6, further comprising:

a portion of said first cable is retained with one of a first pulley and a first semi-circular track, a portion of said second cable is retained with one of a second pulley and a second semi-circular track.

9. The reverse style crossbow of claim 6 wherein:

said bowstring is unwrapped from an inside portion of an outer perimeter of said first and second cams.

10. The reverse style crossbow of claim 6 wherein:

said bowstring is unwrapped from an outside portion of an outer perimeter of said first and second cams.

11. The reverse style crossbow of claim 6 wherein:

a pulley support frame is attached to said one end of said barrel, said first string guide pulley is pivotally retained on one end of said pulley support frame, said second string guide pulley is pivotally retained on an opposing end of said pulley support frame.

12. A reverse style crossbow comprising:

a barrel having an elongated length and a distal end;

a bow riser having a first end and a second end, said bow riser is attached to said barrel;

a first limb extending from said first end of said bow riser;

a second limb extending from said second end of said bow riser;

a first cam includes a first cam track, said first cam is pivotally retained on a distal end of said first limb;

a second cam includes a second cam track, said second cam is pivotally retained on a distal end of said second limb;

a first string guide pulley is pivotally retained on one side of said barrel and adjacent said distal end of said barrel;

a second string guide pulley is pivotally retained on an opposing side of said barrel and adjacent said distal end of said barrel;

a bow string having a first end attached to said first cam, a second end attached to said second cam and supported by said first and second string guide pulleys, said first and second cams being located between said first and second string guide pulleys and said riser, along an axis of said barrel wherein a first end of said bow string unwinds from said first cam, a second end of said bow string unwinds from said second cam;

a first cable having one end retained by said first cam, the other end of said first cable is coupled to said second cam;

a second cable having one end retained by said second cam, the other end of said second cable is coupled to said first cam; and a latch for retaining said bow string in a cocked position, said latch is retained adjacent said barrel, said bow riser is located adjacent said latch.

13. The reverse style crossbow of claim 12 wherein:

said riser is located in one of in front of said latch, behind said latch and below said latch.

14. The reverse style crossbow of claim 12 wherein:

said bowstring is unwrapped from an inside portion of an outer perimeter of said first and second cams.

15. The reverse style crossbow of claim 12 wherein:

said bowstring is unwrapped from an outside portion of an outer perimeter of said first and second cams.

16. The reverse style crossbow of claim 12 wherein:

a pulley support frame is attached to said one end of said barrel, said first string guide pulley is pivotally retained on one end of said pulley support frame, said second string guide pulley is pivotally retained on an opposing end of said pulley support frame.

* * * * *